US008939213B2

(12) United States Patent
Varghese et al.

(10) Patent No.: US 8,939,213 B2
(45) Date of Patent: Jan. 27, 2015

(54) SYSTEMS, SPACER DEVICES AND METHODS FOR ALIGNING MULTI-WELL MODULAR TEMPLATES AND ASSOCIATED WELLS

(75) Inventors: Sibu Varghese, Houston, TX (US); Christopher Loftin, Houston, TX (US); Edward Rositas, Houston, TX (US); Arjin Nolan, Tomball, TX (US); Jesus Aldeguer, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 258 days.

(21) Appl. No.: 13/457,099

(22) Filed: Apr. 26, 2012

(65) Prior Publication Data

US 2013/0284444 A1 Oct. 31, 2013

(51) Int. Cl.
*E21B 41/04* (2006.01)

(52) U.S. Cl.
USPC ..... 166/341; 166/342; 166/366; 175/9; 175/10

(58) Field of Classification Search
USPC ..... 166/341–343, 357, 105, 366; 175/9, 10
See application file for complete search history.

(56) References Cited

U.S. PATENT DOCUMENTS

| | | | | | |
|---|---|---|---|---|---|
| 3,633,667 | A | * | 1/1972 | Falkner, Jr. | 166/366 |
| 4,126,008 | A | * | 11/1978 | Dixon | 405/207 |
| 4,174,011 | A | * | 11/1979 | Zaremba | 175/7 |
| 4,216,835 | A | | 8/1980 | Nelson | |
| 4,317,488 | A | * | 3/1982 | Shotbolt | 166/351 |
| 5,244,312 | A | * | 9/1993 | Wybro et al. | 405/204 |
| 5,526,882 | A | * | 6/1996 | Parks et al. | 166/339 |
| 6,036,404 | A | | 3/2000 | De Medeiros, Jr. et al. | |

FOREIGN PATENT DOCUMENTS

| | | | |
|---|---|---|---|
| GB | 1503398 | A | 3/1978 |
| GB | 2003532 | A * | 3/1979 |
| GB | 2009815 | A * | 6/1979 |

OTHER PUBLICATIONS

PCT International Search Report and Written Opinion dated Nov. 5, 2013 from corresponding Patent Application No. PCT/US2013/038347.

Domangue, "Design and Installation of a Subsea Multiwell Drilling Template at Garden Banks Block 189", SPE Drilling Engineering, pp. 177-181, Sep. 1, 1991.

J Lee, Design and Installation of Deepwater Petroleum Pipelines, date unknown.

* cited by examiner

*Primary Examiner* — James G Sayre
(74) *Attorney, Agent, or Firm* — Bracewell & Giuliani LLP

(57) ABSTRACT

Systems, devices, and methods for providing proper spacing and alignment of multi-well modular drilling templates and associated wells are provided. An example embodiment of a system includes a primary well upon which a multi-well modular drilling template is landed, and a second well upon which a specially configured spacer device is landed. The spacer device includes an alignment frame which engages guide arms of the template to force the spacer device into proper axial alignment. The spacer device includes an elongated arm and a guide funnel which provide the proper spacing and proper location for inserting a third well. The third well can be used as the central well for a second multi-well modular drilling template.

18 Claims, 7 Drawing Sheets

SYSTEMS, SPACER DEVICES AND METHODS FOR ALIGNING MULTI-WELL MODULAR TEMPLATES AND ASSOCIATED WELLS

BACKGROUND OF THE INVENTION

1. Field of the Invention

This invention relates to multi-well modular templates, in general, and systems, apparatus, devices, and methods of well and multi-well modular template alignment, in particular.

2. Description of the Related Art

A multi-well template provides a structure that facilitates drilling operations from a single subsea location. Through use of the multi-well template, all well trees can be located within the structure, and production points can be reached by directional drilling through the respective wells.

Conventional multi-well subsea templates typically require a crane barge or other large support vessel for installation. Multi-well templates have also been limited in size due to structural integrity considerations and deployment equipment limitations.

Smaller well templates have been developed having, for example, nine well funnels. These templates are much easier to deploy and position as they can be deployed using a semi-submersible parked at a fixed location. The need for additional wells provided by the larger structures can, however, outweigh ease of deployment provided by the smaller templates.

Accordingly, recognized by the inventors is the need for a subsea template system which provides for the number well of a larger structures, but only requires the deployment equipment and associated resources of the smaller template structures.

The inventors have also recognized that two or more smaller templates can potentially be utilized form a larger template system. Recognized that to do so, however, would require a robust method to properly position and space the templates in relation to each other. This is particularly true in scenarios where the wells/templates may not be at the same height and/or where the seafloor is not level at the deployment location.

Accordingly, recognized by the inventors is the need for a system and apparatus and/or a spacer device for providing proper spacing and alignment of multiple multi-well templates and associated wells, along with the need for robust methods of employing an apparatus or device for providing/performing proper positioning and spacing between the templates.

SUMMARY OF THE INVENTION

In view of the foregoing, various embodiments of the present invention advantageously provide a system and apparatus and/or device for providing proper spacing and alignment of multiple multi-well templates and their associated wells. Various embodiments of the present invention also provide a robust methods of employing an apparatus or device for providing/performing proper positioning and spacing.

An example of a subsea multi-well drilling template system providing proper spacing and alignment of multiple multi-well templates and their associated wells, according to an embodiment of the present invention, includes a plurality of multi-well modular templates. Each modular template includes a plurality of well funnels connected to form a unitary template structure. A center well funnel of each template has a bore sized to slidably land about and circumscribe a low-pressure housing of a prior completed well to secure the modular template. Additionally, in an exemplary configuration, the well is upside down in relation to the other wells and has a centering ring to help guide the modular template over the well axis.

A second one of the well funnels, positioned along a perimeter of the unitary template structure, has a bore sized to slidably receive and circumscribe a low-pressure housing of a second well. The second well funnel also has a centering ring, but on the upper face of the well, to help guide the low-pressure housing of a second well into the bore.

A spacer device is used to precisely set the spacing and alignment of a third well in relation to the center well of the first modular template which will become the center well of a second multi-well modular template. The second multi-well modular template, typically of the same configuration as the first template, is landed upon/about the third well in a precise position and orientation in relation to the first multi-well modular template.

The spacer device is configured to connect to the second well of the first modular template to provide a positive reference for identifying the location where the third well should be drilled. The spacer device includes a main body having a bore sized to slidably receive and connect to outer surface portions of a low-pressure housing of the second well, a guide funnel having a bore sized to slidably receive a low-pressure housing of the third well, and an elongate spacing arm connected to and extending between the main body and the guide funnel. The spacer device can also include, among other components, an alignment frame configured to engage one or both of the guide arms during operational deployment of the spacer device about the low-pressure housing of the second well. The alignment frame has a pair of guide arms designed to angularly align the elongate spacing arm and the guide funnel to be in line with the well funnels associated with the first and the second wells/and/or one or both of the wells, themselves.

As noted above, various embodiments of the present invention also include methods of spacing and angularly aligning multiple multi-well modular drilling templates or one or more wells associated therewith. An example of such method includes providing first and second multi-well modular drilling templates, as described above. Each drilling template can include a central well funnel for connecting to a low-pressure wellhead housing of a well. At least one of the templates can include a pair of guide arms.

The method also includes providing a multi-well modular drilling template spacer device. The spacer device includes a main body having a bore sized to slidably receive and connect to outer surface portions of a low-pressure housing of a second well extending through one of a plurality of well funnels of a multi-well modular template connected to a low-pressure housing of a first well. The spacer device also includes a guide funnel having a bore sized to slidably receive a low-pressure housing of a third well and an elongate spacing arm connected to and extending between the main body and the guide funnel. The spacer device can also include an alignment frame having a pair of guide arms designed to angularly align the elongate spacing arm and the guide funnel to be in line with the well funnels associated with the first and/or the second wells.

The method further includes angularly orienting the spacer device when connecting the spacer device to the low-pressure housing of the second well so that the position of the guide funnel identifies a proper spacing and alignment of the third well. The step of angularly orienting the spacer device can include connecting the main body of the spacer device to the second well. This step of connecting can include the steps of engaging at least one of the pair of guide arms with one of a pair of acutely angled guide arm contact beams of the alignment frame connected to the elongate spacing arm to cause a simultaneously angular rotation of the spacer device about the low-pressure housing of the second well when landing the main body about the low-pressure housing of the second well.

The method can also include extending drilling equipment through the bore of the guide funnel to drill a wellbore of the third well, and extending the low-pressure housing of the third well through the bore of the guide funnel to position the low-pressure housing of the third well in the wellbore of the third well.

The method can further include disconnecting the spacer device from the low-pressure housing of the second well after inserting the low-pressure housing of the third well through the bore of the guide funnel and into the wellbore of the third well; and connecting the second multi-well modular template to the low-pressure housing of the third well. According to the exemplary configuration, the second multi-well modular drilling template is advantageously in a precisely desired position and orientation in relation to the first multi-well modular drilling template.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Various embodiments of the present invention advantageously provide a system and apparatus and/or device for providing proper spacing and alignment of multiple multi-well templates and/or associated wells. Various embodiments of the present invention also provide robust methods of employing an apparatus or device for providing proper spacing and alignment multiple multi-well templates and/or associated wells.

Figure 1:
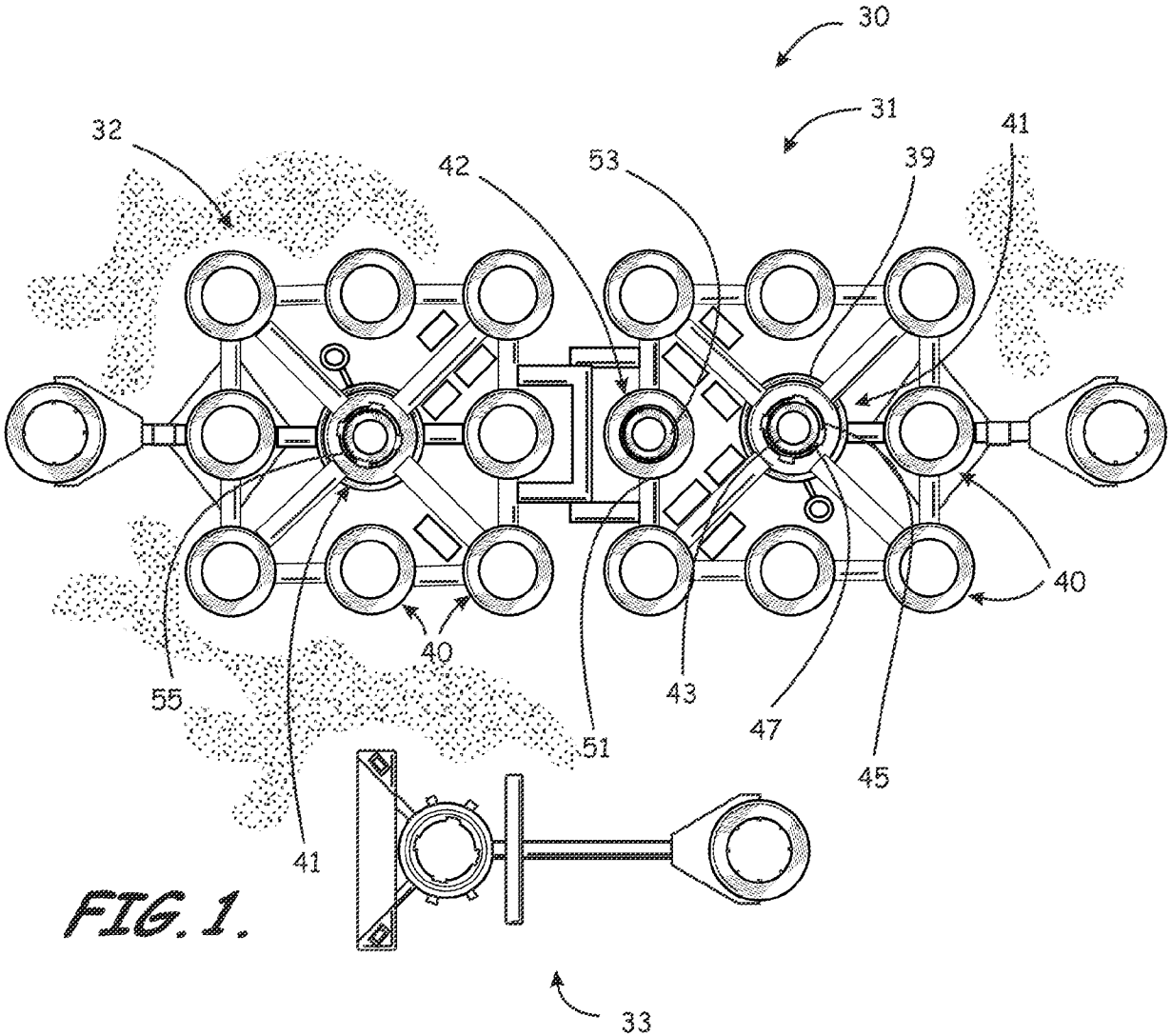
FIG. 1 is a schematic and partially environmental diagram of a general system architecture of a system for spacing and aligning a plurality of multi-well modular drilling templates according to an embodiment of the present invention.

FIG. 1 illustrates an example of a system 30 for providing proper spacing and alignment of a plurality of multi-well modular drilling templates 31, 32 (e.g., two in this example) and/or associated wells according to an embodiment of the present invention. In this illustration, the second multi-well modular template 32 has been properly positioned, aligned, and spaced in relation to the first multi-well modular template 31 utilizing a multi-well drilling template spacer device 33 shown being connected to the second multi-well modular template 32. Each of the multi-well modular templates 31, 32, provide a structure that facilitates drilling operations from a single subsea location. Through use of the multi-well templates, all wellhead trees to be run through the associated well funnels can be located within the respective structures, and production points can be reached by directional drilling through the multiple wellheads.

The first multi-well modular template 31 of the system 30 includes a plurality of well funnels 40 interconnected to form a unitary template structure. One of the well funnels 41, typically located in the center of the structure, is oriented upside down as compared to the other well funnels 40, i.e., with a centering ring 39 on the bottom side in order to provide for connecting template 31 to the first well 43. The well funnel 41 has a center bore 45 sized to slidably land about and circumscribe a low-pressure housing 47 of the first well 43. A second well funnel 42, along with the remaining "other well funnels 40, has its centering ring 51 extending upwardly in order to receive well equipment and components. The second well funnel 42 shown positioned along a perimeter of the unitary template structure, has a bore sized to slidably receive and circumscribe a low-pressure housing of a second well 53.

The second multi-well modular template 32 similarly includes a plurality of well funnels 40 interconnected to form a unitary template structure. Similar or identical to the first template 31, the second template 32 includes a well funnel 41 configured for land about and circumscribe the low-pressure housing of a third well 55 after the location of the third well 55 has been marked by the spacer device 33 and, in an exemplary configuration, when the well 55 has been prepared. Note, the spacer device 33 can be connected to a fourth well (not shown) in order to space and align more than two drilling templates with each other according to one or more embodiments of the present invention.

Figure 2:
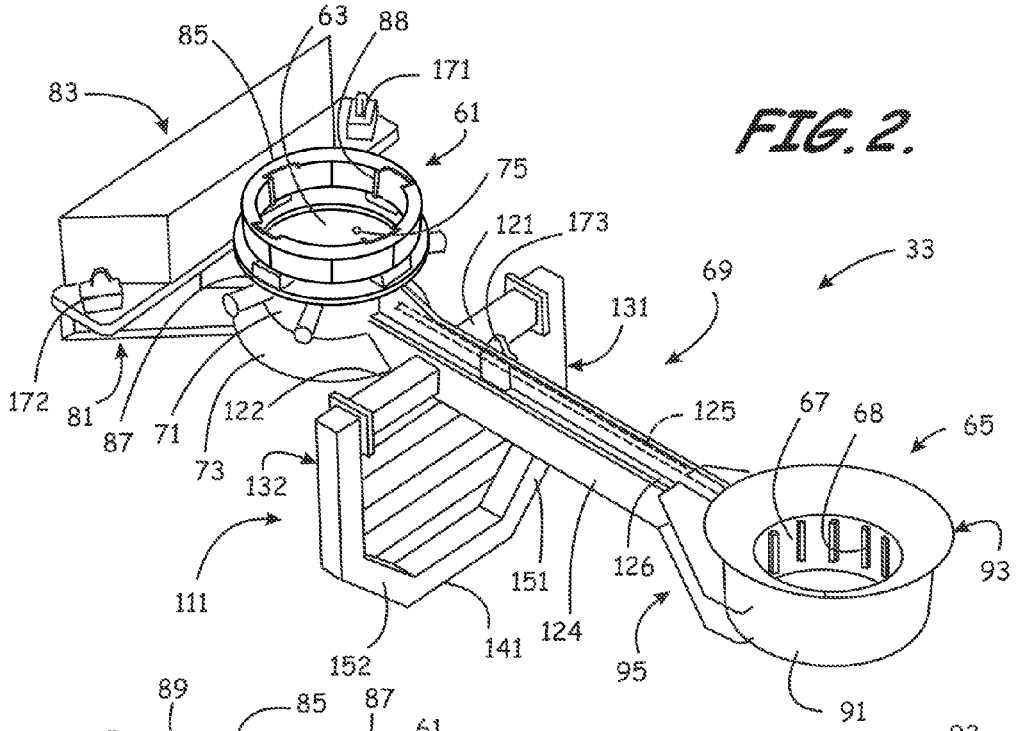
FIG. 2 is a perspective view of a multi-well modular drilling template spacer device for spacing and aligning wells and multi-well modular drilling templates according to an embodiment of the present invention.
Figure 3:
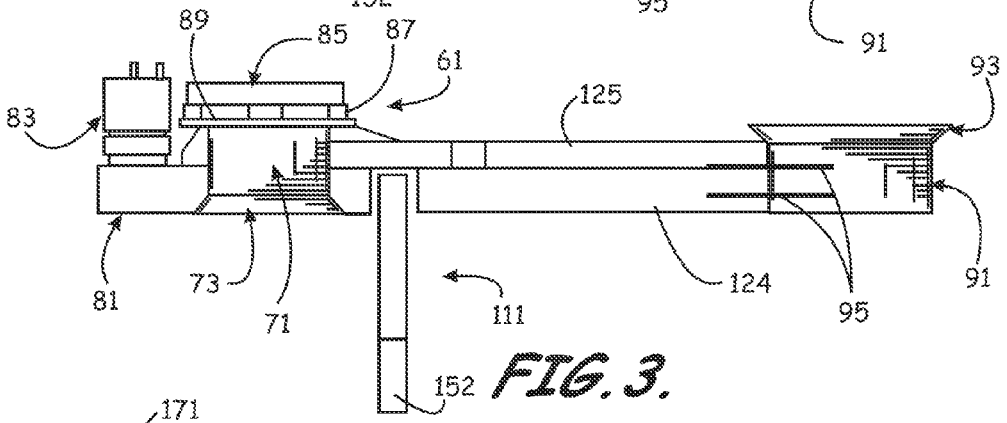
FIG. 3 is a is a side schematic view of the spacer device of FIG. 2 according to an embodiment of the present invention.
Figure 4:
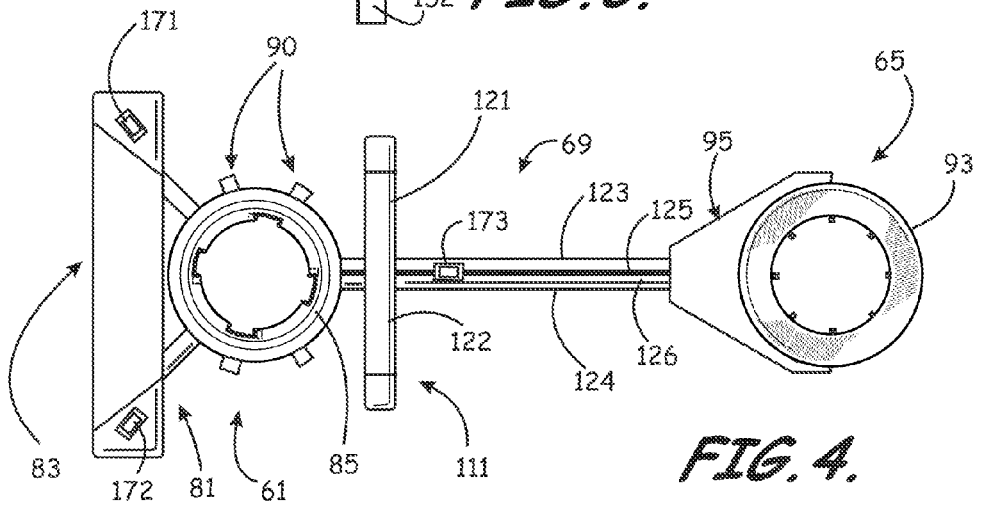
FIG. 4 is a is a top schematic view of the spacer device of FIG. 2 according to an embodiment of the present invention.

FIGS. 2-4 illustrate an exemplary configuration of the multi-well modular drilling template spacer device 33. The spacer device 33 can be employed to space and align at least one well of the second multi-well modular template 32 in relation to at least one well of the first multi-well modular template 31, and/or to space and align the second multi-well modular template in relation to the first multi-well modular template. Note, although only two multi-well drilling templates are illustrated, additional templates can be employed. Also, although the illustrated multi-well modular drilling templates are shown having nine well funnels, templates having more or less well funnels are within the scope of the present invention.

Referring to FIG. 2, the spacer device 33 includes a main body 61 having a bore 63 sized to slidably receive and connect to outer surface portions of a low-press and guide Rams ure housing of the second well 53, a guide funnel 65 having a bore 67 including spacing ribs 68 sized to slidably receive a low-pressure housing of a third well 55, and an elongate spacing arm 69 connected to and extending between the main body 61 and the guide funnel 65.

According to the illustrated configuration, the main body 61 has a reverse-funnel shape to provide for landing about and connecting to low-pressure housing of the well 53 (or other well extending through one of the funnels 42). The main body 61 includes an at least approximately cylindrical portion 71 having the bore 63 extending therethrough. The bore 63 is sized so that the inner diameter substantially matches the outer diameter of the low-pressure housing of the well 53. A centering ring portion 73 is connected to or integral with a lower end of the cylindrical portion 71. Referring also to FIG. 3, the centering ring portion 73 has a substantially frustroconical shape to thereby guide the main body 61 to a position over a central axis of the low-pressure housing of the second well 53 during operational deployment of the spacer device 33.

Figure 5:
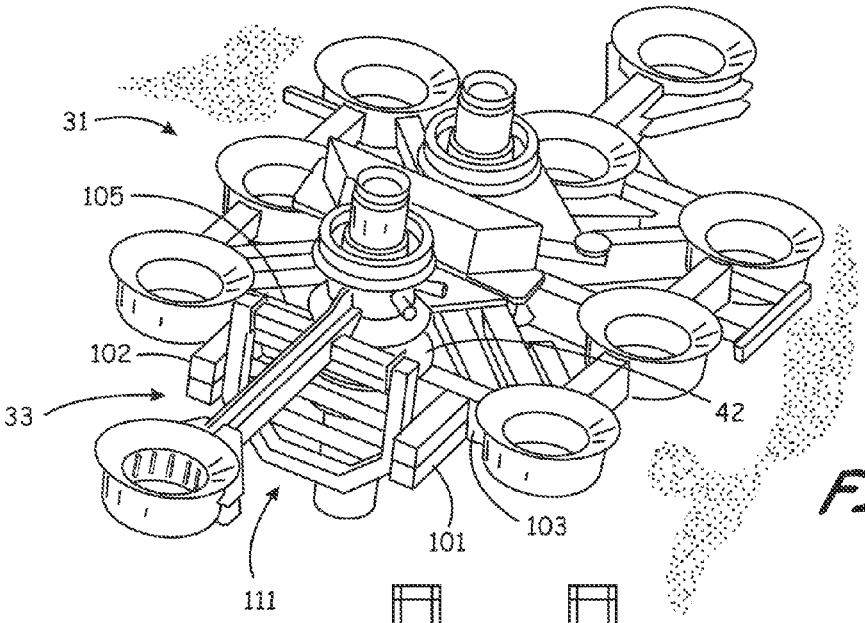
FIG. 5 is a perspective view of a multi-well modular drilling template spacer device connected to a multi-well modular drilling template according to an embodiment of the present invention.
Figure 6:
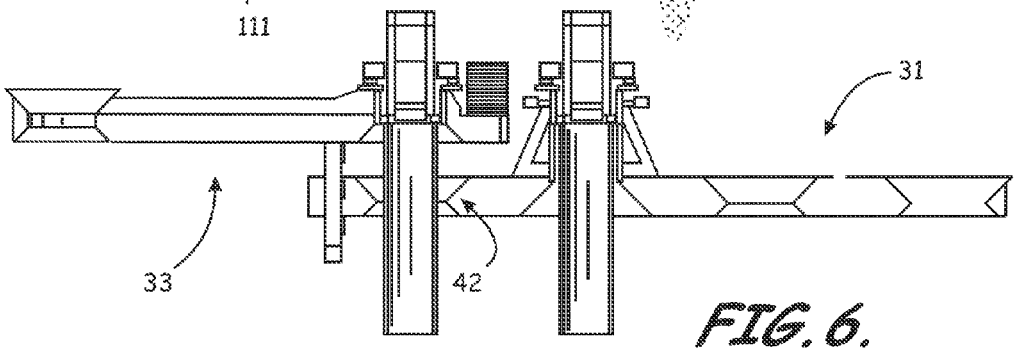
FIG. 6 is a side schematic view of the spacer device connected to a well extending through a well funnel of the template shown in FIG. 5 according to an embodiment of the present invention.

Referring again to FIG. 2, at least two dogs 75 are contained within the bore 63 in order to engage corresponding recesses/latching mechanisms (not shown) positioned on or connected to the outer surface of the low-pressure housing of the well 53. FIGS. 5 and 6 illustrate the positioning of the spacer device 33 when connected to the well 53.

Referring to FIGS. 2-4, a support pylon 81 is connected to the main body 61 at a position opposite the elongate spacing arm 69. A counterweight 83 is connected to an upper surface of the support pylon 81 to counterbalance the weight of the spacing arm 69 and components connected to the spacing arm 69, to include the guide funnel 65 and corresponding support structure.

Referring to FIGS. 2 and 3, a latch ring 85 is connected to and coaxial with the main body 61 via a plurality of connecting blocks 87, themselves connected to an upper rim 89 of the main body 61. The latch ring 85 is configured to connect to a running tool (see, e.g., FIG. 16B) during operational deployment or retrieval of the spacer device 33 about the outer surface of the low-pressure housing of the well 53, typically conducted using a semi-submersible. A set of anti-rotation keys 88 and guide rims prevent rotation about the radial axis once connected to the running tool. Also referring to FIG. 4, a plurality of ROV interfaces 90 are connected to outer surface portions of the main body 61.

Referring primarily to FIGS. 2 and 4, the guide funnel 65 has a funnel shape to provide for receiving drilling and well equipment and components including the low-pressure housing of the third well 55, or other well low-pressure housing, etc. (see, e.g., FIG. 16D). The guide funnel 65 includes an at least approximately cylindrical portion 91 having the bore 67 extending therethrough. According to the exemplary configuration, the bore 67 is sized so that the inner diameter is a maximum of approximately 1 inch larger than the outer diameter of the low-pressure housing of the well 55 to ensure precise alignment.

The guide funnel 65 also includes a centering ring portion 93 connected to an upper end of the cylindrical portion 91 having a substantially frustroconical shape to help guide the low-pressure housing of the well 55 (or other similar well) into alignment with a central axis of the guide funnel during operational insertion thereof when the low-pressure housing is off axis.

One or more support flanges 95 are connected to and at least partially circumscribe substantial outer surface portions of the cylindrical portion 91 of the guide funnel 65 and are connected to the elongate spacing arm 69 to provide torsional support during off-center engagement of the centering ring portion 93.

Referring to FIGS. 7-13, it can be seen that at least the first multi-well modular template 31, but more typically, each of the plurality of multi-well modular templates, include a pair of guide arms 101, 102, extending along a same plane as the unitary template structure of the template 31. The guide arms 101, 102, project outwardly from separate portions of the structure/structural portion 103, 105, supporting the well funnel 42. The guide arms 101, 102, are positioned adjacent either side of well funnel 42 in order to assist in angularly orienting the spacer device 33 when connecting the main body 61 of the spacer device 33 to the low-pressure housing of the well 53 or any subsequent wells.

Figure 7:
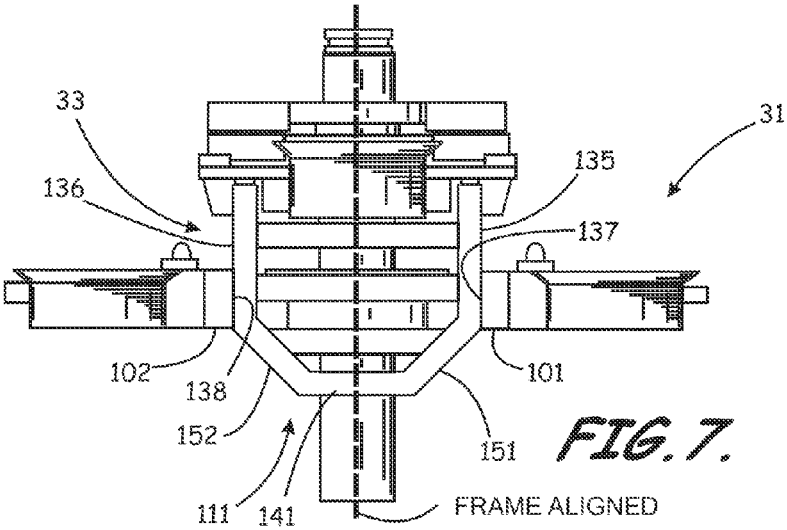
FIG. 7 is a front schematic flow view of the spacer device illustrating an alignment frame of the device positioned between guide arms of the template according to an embodiment of the present invention.

Referring primarily to FIGS. 2 and 7, the spacer device 33 correspondingly further includes an alignment frame 111 configured to engage one or both of the guide arms 101, 102, during operational deployment of the spacer device 33 about the low-pressure housing of the well 53 to angularly align the elongate spacing arm 69 and guide funnel to be in line with the well funnels 41, 42 associated with the wells 51, 53, or as desired by the user.

According to the illustrated configuration, the alignment frame 111 is connected to one or more support beams 121, 122, connected to one or more flanges 123, 124, 125 or the center I-beam 126 collectively defining the elongate spacing arm 69. The alignment frame 111 can include a pair of parallel side beams 131, 132 connected to or integral with the one or more support beams 121, 122 and spaced apart so that a distance between outer surface portions 135, 136, of the parallel side beams 131, 132, is insubstantially less than a distance between inner surface portions 137, 138, of the guide arms 101, 102, of the multi-well modular template 31. In the exemplary configuration, when ideally positioned, there will be a preselected clearance of, e.g., ½ in, between the outer surface portions 135, 136 of the parallel side beams 131, 132 of the alignment frame 111 and the inner surface portions 137, 138 (see FIG. 7) of the guide arms 101, 102. This preselected design clearance provides a tolerance of a 1 inch off-center alignment (plus or minus ½ inch) as measured at the guide frame 111. Note, the design provision of stronger or weaker tolerances are, of course, within the scope of the present invention, as with others throughout.

The alignment frame 111 includes a bottom beam 141 oriented approximately parallel to the one or more support beams 121, 122, perpendicular to the pair of parallel side beams 131, 132, and configured to engage the subsea floor (FIG. 9) to provide a lower deployment limit when the main body 61 of the spacer device 33 is slidably engaging outer surface portions of the low-pressure housing of the well 53. The bottom beam 141 has a length substantially smaller than a distance between inner surface portions 143, 145 of the parallel side beams 131, 132.

Figure 8:
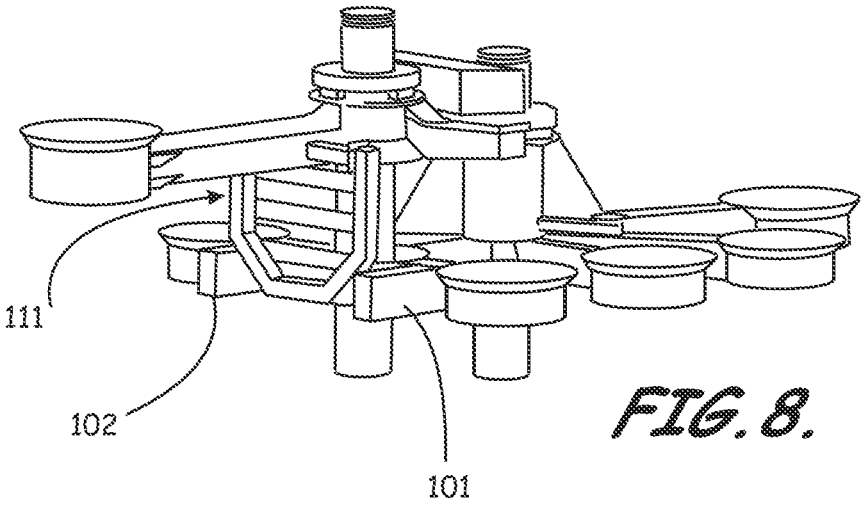
FIG. 8 is a perspective view of the spacer device connected to a well in the template having a positive axial misalignment with respect to the well upon which the template is installed according to an embodiment of the present invention.
Figure 9:
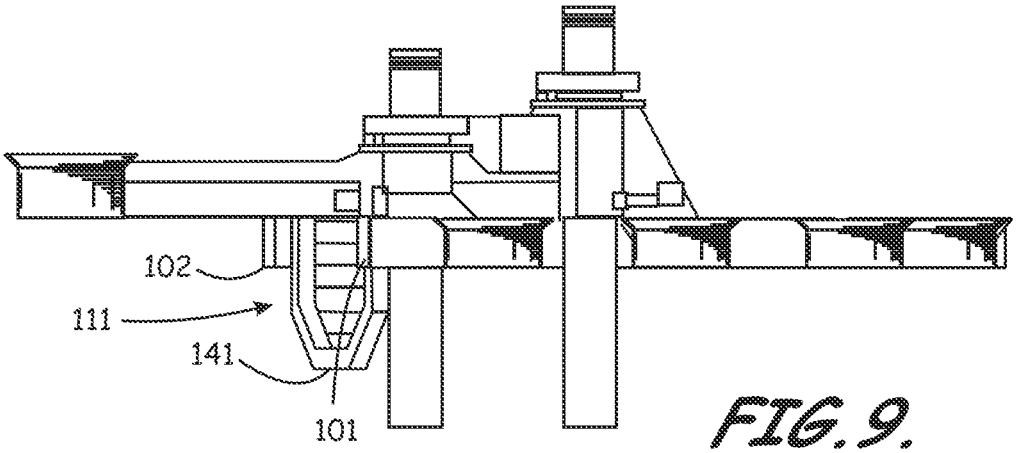
FIG. 9 is a perspective view of the spacer device connected to a well in the template having a negative axial misalignment with respect to the well upon which the template is installed according to an embodiment of the present invention.

FIG. 8 illustrates that in the exemplary configuration, the design of the alignment frame 111 provides the alignment frame 111 the ability to center the orientation of the spacer device 33 at a preselected design distance (e.g., ½ m) above the normal position of the multi-well modular templates 31. Similarly, FIG. 9 illustrates that in the exemplary configuration, the design of the alignment frame 111 provides the alignment frame 111 the ability to center the orientation of the spacer device 33 at a preselected distance (e.g., ½ m) below the normal position of the multi-well modular template 31.

Referring to FIGS. 7 and 10-12, the alignment frame 111 includes a pair of guide arm contact beams 151, 152, each separately extending between one of the opposite ends of the bottom beam 141 and a lower end of the respective side beam 131, 132. Each guide arm contact beam 151, 152, is oriented at a substantially acute angle to slidably contact the guide arms 101, 102 of the multi-well modular template 31 during operational positioning of the main body 61 of the spacer device 33 about the outer surface portions of the low-pressure housing of the well 53. According to the exemplary configuration, the alignment frame 111 has a lead of greater than 50 degrees which guides it to a proper alignment with multi-well modular template 31 as shown, for example, in FIGS. 5-7. That is, during deployment, if the elongate arm 69 of the spacer device 33 is misaligned as shown, for example, in FIGS. 10-12, the outer surfaces of the contact beams 151 or 152 will contact the inner surface portions 137 or 138 of the guide arms 101 or 102, which will cause the spacer device 33 to rotate about the longitudinal axis of the low-pressure housing of the well 53 to adjust an angular position of the elongate spacing arm 69, when the arm is misaligned, and the position shown in FIGS. 5-7.

Figure 10:
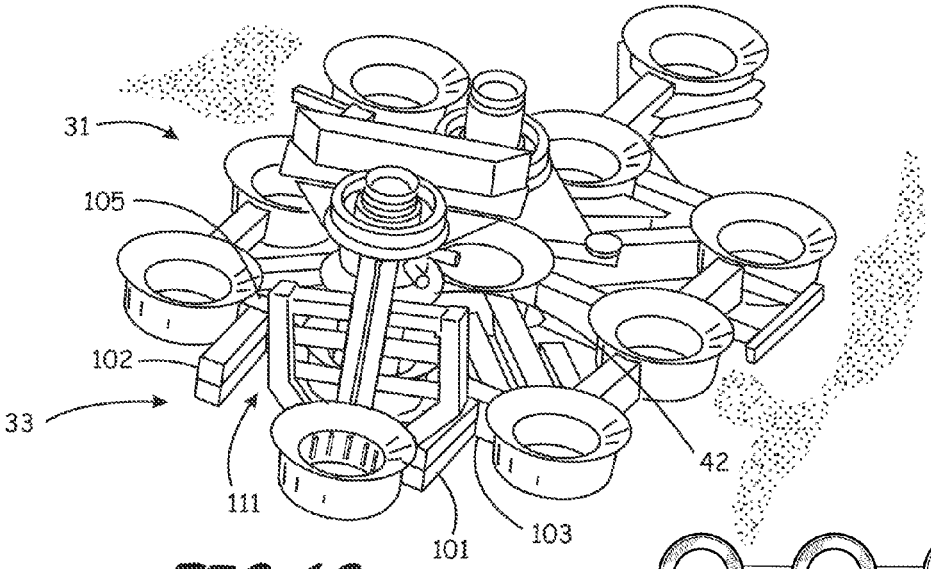
FIGS. 10-12 show an angled side, top, and front perspective view, respectively, of the spacer device connected to the template file with a guide funnel and an initially off-axis position during installation according to an embodiment of the present invention.
Figure 11:
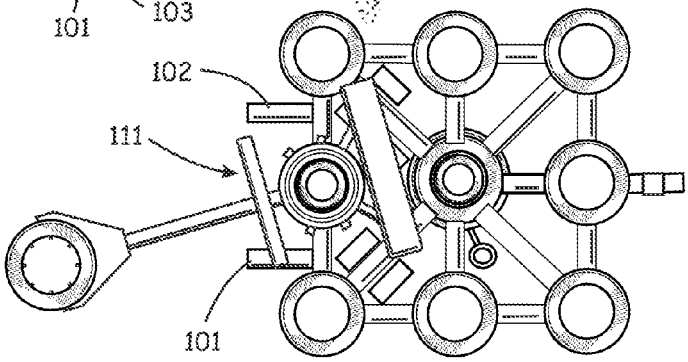
Figure 12:
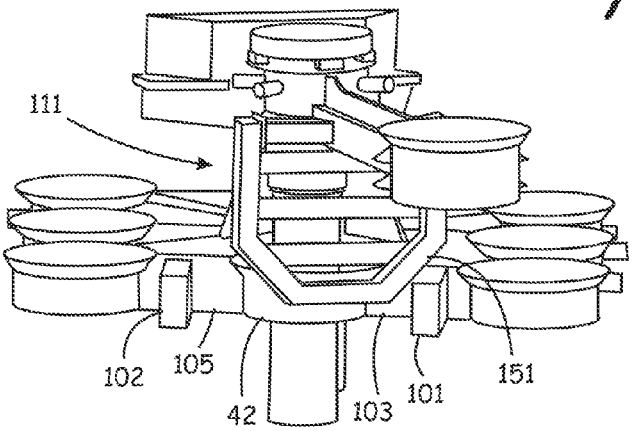
Figure 13:
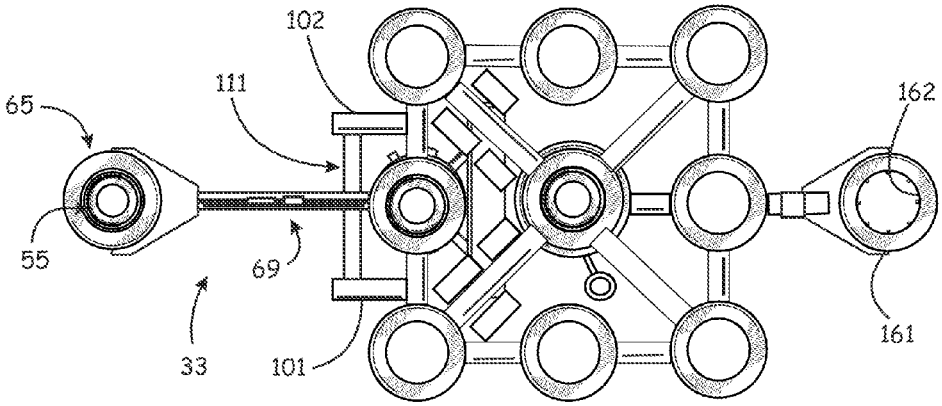
FIG. 13-15 provide a top, angled side, and side perspective view illustrating a connection of the spacer device shown in FIGS. 10-12 guided into proper alignment according to an embodiment of the present invention.

FIGS. 10-12 illustrate an example whereby the spacer device 33 is landing about the well 53 but with the elongate spacing arm 69 at a slight acute angle off-axis. With weight down forces, it can be seen that the alignment frame 111 will guide the arm 69 into proper alignment with the axis extending between the wells 43, 53. FIGS. 5-7 and 13 illustrate an example whereby the spacer device 33 is connected to the well 53, and the arm 69 has been properly guided into the proper position in relation to the wells 43, 53 and the unitary/modular structure of the template 31. FIG. 13 further illustrates that the arm 69 can be swung in either direction depending on whether it is left of center line or right of center line when being landed about the well 53.

Referring to FIGS. 7 and 13-15, it can be seen that the spacer device 33 landed on the well 53 controls the positional orientation of the "third" well 55 to be drilled to within a preselected tolerance, e.g., plus or minus 1 inch and radial direction (i.e., plus or minus ½ inch radial misalignment), in the exemplary configuration. Similarly, FIGS. 8-9 illustrate that, in the exemplary configuration, the spacer device 33 allows for a plus or minus ½ meter axial alignment. Other preselected tolerances, however, are within the scope of the present invention.

Figure 14:
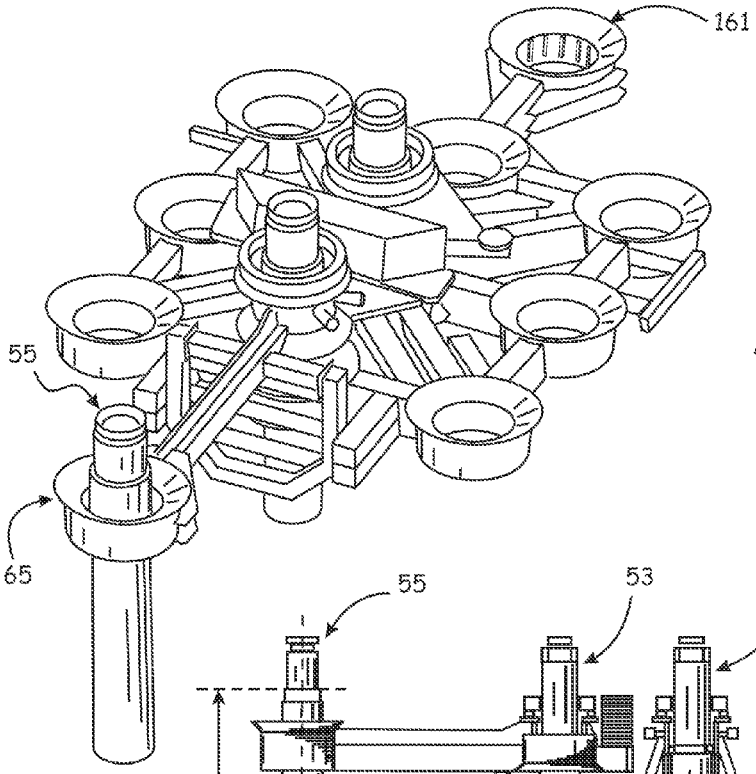
Figure 15:
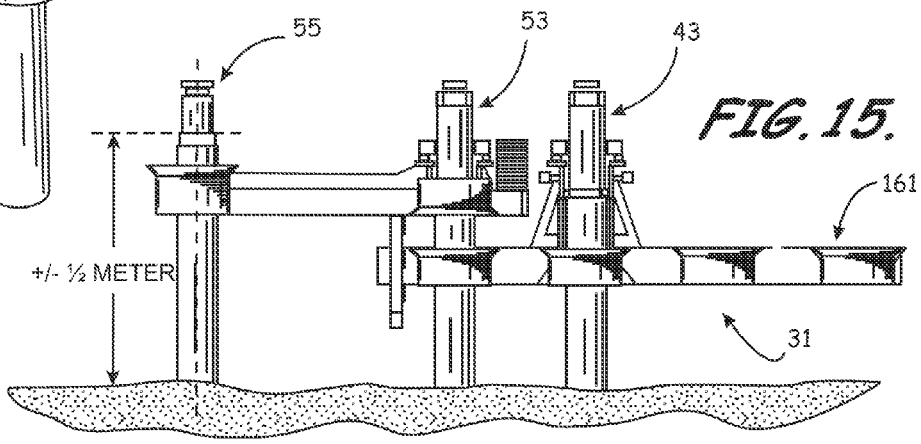

Referring to FIGS. 13-15, each multi-well modular template 31, 32, can include a drop away funnel 161 connected adjacent one of the well funnels 40 positioned along the perimeter of the unitary template structure. The drop away funnel 161 has a bore 162 sized to slidably receive and circumscribe a drilling rig pylon (not shown). The drop away funnel 161 is oriented in relation to the unitary template structure of the respective multi-well modular template 31, 32, to provide for aligning the drilling rig with the respective multi-well modular template 31, 32.

Figure 16A:
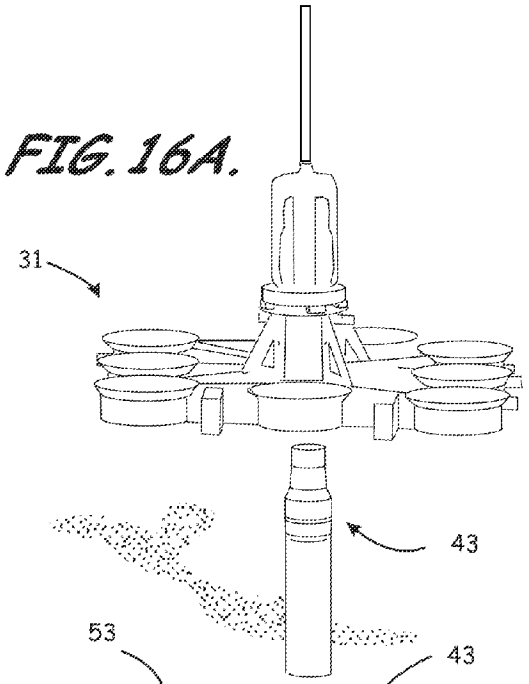
FIGS. 16A-16D illustrate select steps for installing a properly guided well in relation to a modular template utilizing a multi-well modular drilling template spacer device according to an embodiment of the present invention.
Figure 16B:
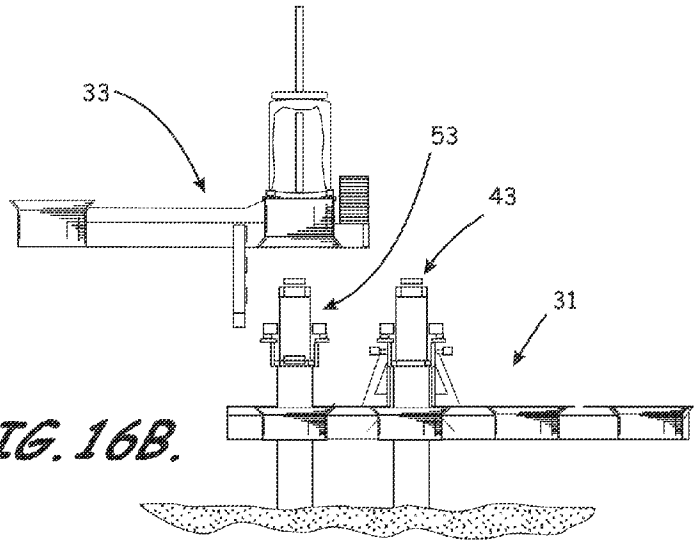
Figure 16C:
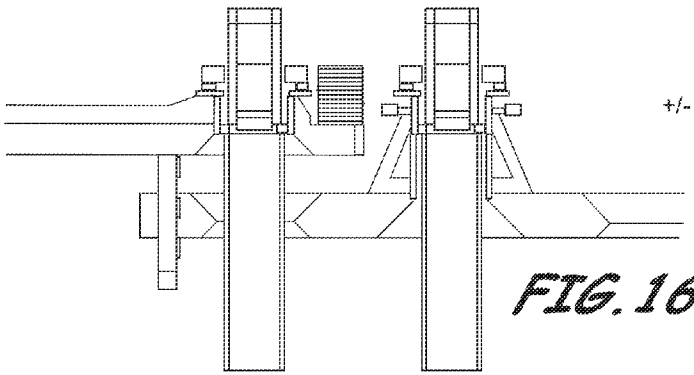
Figure 16D:
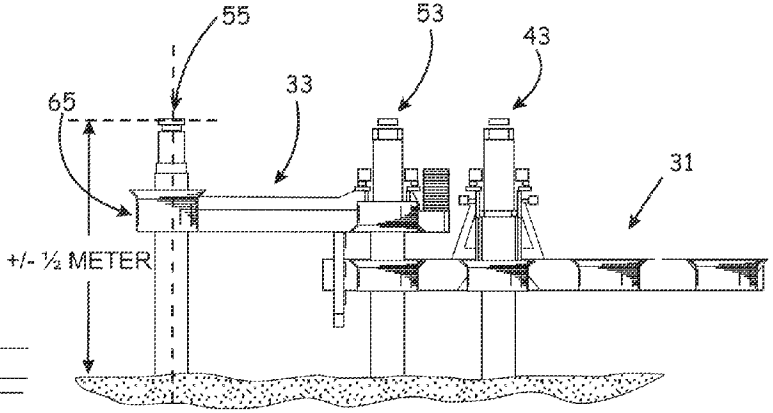

Referring to FIGS. 16A-1D, in operation, after drilling the first well 43 to target depth (completion), the first multi-well modular template 31 is installed to the well 43 (see FIG. 16A). The second well 53 is then drilled to target depth at the specified location using the template funnel guide 42 for proper alignment (see FIG. 16B). The spacer device 33 is then installed onto the wellhead of the second well 53 (see FIG. 16C). As shown in FIG. 4, the spacer device 33 includes a plurality of connecting eyelets 171-173, which can be used for lowering the spacer 33 from the vessel. As shown in FIGS. 10-12, utilizing the alignment frame 111, the spacer device 33 self-aligns. The third well 55 is then drilled using the guide funnel 65 to accurately position it to within a predetermined/prespecified radial direction (see FIGS. 16D and 7).

Various embodiments of the present invention provide several advantages. For example, an embodiment of the present invention provides a spacer (structural) device designed to position, align, and orient the drilling location of the primary (first) well to a secondary one within a full radial circumference of 360 degrees, and/or to accurately align multiple drilling templates, one to another. In an embodiment, the spacer device can compensate for axial alignment of the well depth within a specified distance to assure proper function according to the respective configuration. In an embodiment, the specified distance is plus or minus ½ meter from the main central well upon which the template is initially installed. In an embodiment, alignment of the subsequent third well is assured to within a specified distance along the axis of the main central well which the template is initially installed. In an embodiment, the specified distance is plus or minus ½ inch.

In an embodiment, due to the shape of the stab-in links on the dogs of the spacer and similar modification to a dedicated tool, the system/methods allow the template to have up to approximately 4 degrees of axial misalignment (off level) on the sea floor to facilitate stab in and out of the spacer with the fixed tool on the rig, when installed to the wellhead and while resting on the sea bed. In an embodiment, the dogs that latch spacer to wellhead housing are located at specific angle to prevent cocking of the spacer when impacted with loads from the drill pipe, casing preventing it from popping off. In an embodiment, the spacer allows for approximately 75000 lbf of impact loading from drill pipe, casing or any debris that could fall from the rig to the sea bed. In an embodiment, the spacer allows for approximately 10 in. of vertical misalignment with respect to the well being drilled from desired location. In an embodiment, the spacer can be reused multiple times as long as the arm of the spacer is within 10 in. of vertical misalignment. In an embodiment, the alignment frame allows easy stab in of the spacer to the template and prevent any rotational misalignment which could impact the position/location of the well being drilled.

In an embodiment, the spacer device provides options for installations to include the ability to run the device directly from a rig/vessel using either slings or a guide tool. According to an embodiment, multiple wells can be drilled at one location from a fixed or floating platform. In an embodiment, the spacer device is sized to be easily transported via rig, ship, barge, or land systems. In an embodiment, the spacer can be run through the moon pool of a rig as a single piece. In an embodiment, the spacer can be run with multiple tools; i.e., a dedicated tool attached to the spacer and/or a tool with slings. In an embodiment, the spacer can be retrieved using a fixed dedicated tool or sling tool. In an embodiment, the spacer can be rotated to orient itself to the template by applying a torque to the fixed tool without fear of disengaging the spacer from the tool. A set of recesses along the inner diameter of the latch ring can be provided to prevent tool rotation during rotation of the spacer. In an embodiment, the center of gravity of the spacer and be easily maintained irrespective of weather conditions while operating/using the spacer for its intended purpose. In an embodiment, the spacer allows a one-way installation with the template. In an embodiment, the spacer can be assembled/disassembled into one piece on the rig to facilitate transportation of the spacer through road, small ships, etc.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A multi-well modular drilling template spacer device to space and angularly align at least one multi-well modular drilling template of a plurality of multi-well modular drilling templates or one or more wells associated therewith, in relation to at least one other multi-well modular drilling template of the plurality of multi-well modular templates or one or more wells associated therewith, the multi-well modular drilling template spacer device comprising:

a main body having a bore sized to slidably receive and connect to outer surface portions of a low-pressure housing of a second well extending through one of a plurality of well funnels of a multi-well modular template connected to a housing of a first well, the main body comprising an at least approximately cylindrical portion and a centering ring portion connected to a lower end of the at least approximately cylindrical portion, the centering ring portion having a substantially frustroconical shape to thereby guide the main body over a central axis of the low-pressure housing of the second well during operational deployment thereof;

a guide funnel having a bore sized to slidably receive a low-pressure housing of a third well; and an elongate spacing arm connected to and extending between the main body and the guide funnel.

2. The multi-well modular drilling template spacer device as defined in claim 1, wherein the plurality of well funnels of the multi-well modular template are connected to form a unitary template structure, wherein the multi-well modular template comprises a pair of guide arms extending along a same plane as the unitary template structure thereof and projecting outwardly from portions of the unitary template structure located on either side of and adjacent to the one of the plurality of well funnels circumscribing the low-pressure housing of the second well, and wherein the spacer device further comprises:

an alignment frame configured to engage one or both of the guide arms during operational deployment of the spacer device about the low-pressure housing of the second well to angularly align the elongate spacing arm and the guide funnel to be in line with the well funnels associated with the first and the second wells.

3. The multi-well modular drilling template spacer device as defined in claim 2, wherein the alignment frame is connected to one or more support beams connected to the elongate spacing arm, and wherein the alignment frame comprises:

a pair of parallel side beams connected to or integral with the one or more support beams and spaced apart so that a distance between outer surface portions of the parallel side beams is insubstantially less than a distance between inner surface portions of the guide arms of the multi-well modular template;

a bottom beam oriented approximately parallel to the one or more support beams, perpendicular to the pair of parallel side beams, and configured to engage the subsea floor to provide a lower deployment limit when the main body of the spacer device is slidably engaging outer surface portions of the low-pressure housing of the second well, the bottom beam having a length substantially smaller than a distance between inner surface portions of the parallel side beams; and a pair of guide arm contact beams each separately extending between one of the opposite ends of the bottom beam and a lower end of the respective side beam, each guide arm contact beam is oriented at a substantially acute angle to slidably contact a respective one of the guide arms of the multi-well modular template during operational positioning of the main body of the spacer device about the outer surface portions of the low-pressure housing of the second well to thereby rotate the spacer device about the longitudinal axis of the low-pressure housing of the second well to adjust an angular position of the elongate spacing arm when the arm is misaligned.

4. The multi-well modular drilling template spacer device as defined in claim 1, further comprising:

a latch ring connected to and coaxial with the main body, the latch ring configured to connect to a running tool during operational deployment of the spacer device about outer surface portions of the low-pressure housing of the second well; and a plurality of dogs positioned within the bore of the main body and configured to engage outer surface portions of the low-pressure housing of the second well to connect the main body thereto.

5. The multi-well modular drilling template spacer device as defined in claim 1, further comprising:

a support pylon connected to the main body opposite the elongate spacing arm; and a counterweight connected to the support pylon to counterbalance weight of the elongate spacing arm and components connected thereto.

6. The multi-well modular drilling template spacer device as defined in claim 1, further comprising:

one or more support flanges connected to and at least partially circumscribing substantial outer surface portions of the guide funnel and connected to the elongate spacing arm to provide torsional support during off-center engagement of a centering ring portion of the guide funnel during operational deployment of the low-pressure housing for the third well.

7. A multi-well modular drilling template spacer device to space and angularly align at least one multi-well modular drilling template of a plurality of multi-well modular drilling templates or one or more wells associated therewith in relation to at least one other multi-well modular drilling template of the plurality of multi-well modular templates or one or more wells associated therewith, the multi-well modular drilling template spacer device comprising:

a main body having a bore sized to slidably receive and connect to outer surface portions of a low-pressure housing of a second well extending through one of a plurality of well funnels of a multi-well modular template connected to a housing of a first well;

a guide funnel having a bore sized to slidably receive a low-pressure housing of a third well, the guide funnel comprising an at least approximately cylindrical portion and a centering ring portion connected to an upper end of the at least approximately cylindrical portion, the centering ring portion having a substantially frustroconical shape to thereby guide the low-pressure housing of the third well in alignment with a central axis of the guide funnel during operational insertion thereof; and an elongate spacing arm connected to and extending between the main body and the guide funnel.

8. A subsea multi-well drilling template system, the system comprising:

a first multi-well modular template of a plurality of multi-well modular templates, the first multi-well modular template comprising a plurality of well funnels connected to form a unitary template structure, a first one of the plurality of well funnels having a bore sized to slidably land about and circumscribe a low-pressure housing of a first well, a second one of the plurality of well funnels positioned along a perimeter of the unitary template structure and having a bore sized to slidably receive and circumscribe a low-pressure housing of a second well;

a spacer device configured to space and angularly align at least one well of a second multi-well modular template of the plurality of multi-well modular templates in relation to at least one well of the first multi-well modular template, and to space and angularly align the second multi-well modular template in relation to the first multi-well modular template, the spacer device comprising a main body having a bore sized to slidably receive and connect to outer surface portions of the low-pressure housing of the second well, a guide funnel having a bore sized to slidably receive a low-pressure housing of a third well, and an elongate spacing arm connected to and extending between the main body and the guide funnel; and a second multi-well modular template comprising a plurality of well funnels connected to form a unitary template structure, a first one of the plurality of well funnels having a bore sized to land about and circumscribe the low-pressure housing of the third well after removal of the spacer device.

9. The system as defined in claim 8, wherein the first multi-well modular template comprises a pair of guide arms extending along a same plane as the unitary template structure thereof and projecting outwardly from separate portions of the structure located on either side of and adjacent to the second one of the plurality of well funnels for angularly orienting the spacer device when connecting the spacer device to the low-pressure housing of the second well.

10. The system as defined in claim 9, wherein the spacer device further comprises an alignment frame configured to engage one or both of the guide arms during operational deployment of the spacer device about the low-pressure housing of the second well to angularly align the elongate spacing arm and the guide funnel to be in line with the well funnels associated with the first and the second wells.

11. The system as defined in claim 10, wherein the alignment frame is connected to one or more support beams connected to the elongate spacing arm, and wherein the alignment frame comprises:

a pair of parallel side beams connected to or integral with the one or more support beams and spaced apart so that a distance between outer surface portions of the parallel side beams is insubstantially less than a distance between inner surface portions of the guide arms of the first multi-well modular template;

a bottom beam oriented approximately parallel to the one or more support beams, perpendicular to the pair of parallel side beams, and configured to engage the subsea floor to provide a lower deployment limit when the main body of the spacer device is slidably engaging outer surface portions of the low-pressure housing of the second well, the bottom beam having a length substantially smaller than a distance between inner surface portions of the parallel side beams; and a pair of guide arm contact beams each separately extending between one of the opposite ends of the bottom beam and a lower end of the respective side beam, each guide arm contact beam is oriented at a substantially acute angle to slidably contact a respective one of the guide arms of the first multi-well modular template during operational positioning of the main body of the spacer device about the outer surface portions of the low-pressure housing of the second well to thereby rotate the spacer device about the longitudinal axis of the low-pressure housing of the second well to adjust an angular position of the elongate spacing arm when the arm is misaligned.

12. The system as defined in claim 8, wherein the main body of the spacer device comprises an at least approximately cylindrical portion and a centering ring portion connected to a lower end of the at least approximately cylindrical portion, the centering ring portion having a substantially frustroconical shape to thereby guide the main body of the spacer device over a central axis of the low-pressure housing of the second well during operational deployment thereof.

13. The system as defined in claim 8, wherein the guide funnel comprises an at least approximately cylindrical portion and a centering ring portion connected to an upper end of the at least approximately cylindrical portion, the centering ring portion having a substantially frustroconical shape to thereby guide the low-pressure housing of the third well in alignment with a central axis of the guide funnel during operational insertion thereof.

14. The system as defined in claim 13, wherein the spacer device further comprises:

a latch ring connected to and coaxial with the main body of the spacer device, the latch ring configured to connect to a running tool during operational deployment of the spacer device about outer surface portions of the low-pressure housing of the second well;

a support pylon connected to the main body of the spacer device opposite the elongate spacing arm;

a counterweight connected to an upper surface of the support pylon to counterbalance weight of the elongate spacing arm and components connected thereto; and one or more support flanges connected to and at least partially circumscribing substantial outer surface portions of the guide funnel and connected to the elongate spacing arm to provide torsional support during off-center engagement of centering ring portion of the guide funnel during operational deployment of the low-pressure housing for the third well.

15. The system as defined in claim 8, wherein the first multi-well modular template comprises a drop away funnel connected adjacent a third one of the plurality of well funnels positioned along the perimeter of the unitary template structure, the drop away funnel having a bore sized to slidably receive and circumscribe a drilling rig pylon, the drop away funnel oriented in relation to the unitary template structure of the first multi-well modular template to provide for aligning the drilling rig with the first multi-well modular template.

16. A method of spacing and angularly aligning multiple multi-well modular drilling templates or one or more wells associated therewith, the method comprising the steps of:

providing a multi-well modular drilling template spacer device comprising a main body having a bore sized to slidably receive and connect to outer surface portions of a low-pressure housing of a second well extending through one of a plurality of well funnels of a multi-well modular template connected to a low-pressure housing of a first well, a guide funnel having a bore sized to slidably receive a low-pressure housing of a third well, and an elongate spacing arm connected to and extending between the main body and the guide funnel;

angularly orienting the spacer device when connecting the spacer device to the low-pressure housing of the second well so that the position of the guide funnel identifies a proper spacing and alignment of the third well;

extending drilling equipment through the bore of the guide funnel to drill a wellbore of the third well; and extending the low-pressure housing of the third well through the bore of the guide funnel to position the low-pressure housing of the third well in the wellbore of the third well.

17. A method as defined in claim 16, wherein the plurality of well funnels of the multi-well modular template are connected to form a unitary template structure, wherein the multi-well modular template comprises a pair of guide arms extending along a same plane as the unitary template structure thereof and projecting outwardly from portions of the unitary template structure located on either side of and adjacent to the one of the plurality of well funnels circumscribing the low-pressure housing of the second well, and wherein the step of angularly orienting the spacer device includes the steps of:

connecting the main body of the spacer device to the second well, the step of connecting comprising the steps of engaging at least one of the pair of guide arms with a corresponding at least one of a pair of acutely angled guide arm contact beams of an alignment frame connected to the elongate spacing arm to cause a simultaneous angular rotation of the spacer device about the low-pressure housing of the second well when landing the main body about the low-pressure housing of the second well.

18. A method as defined in claim 16, wherein the multi-well modular template is a first multi-well modular template, and wherein a first one of a plurality of well funnels of a second multi-well modular template has a bore sized to land about and circumscribe the low-pressure housing of the third well, the method further comprising the steps of:

disconnecting the spacer device from the low-pressure housing of the second well after inserting the low-pressure housing of the third well through the bore of the guide funnel and into the wellbore of the third well; and connecting the second multi-well modular template to the low-pressure housing of the third well.

* * * * *